US010876273B2

(12) United States Patent
Kozui et al.

(10) Patent No.: US 10,876,273 B2
(45) Date of Patent: Dec. 29, 2020

(54) CONSTRUCTION MACHINE

(71) Applicant: KOBELCO CONSTRUCTION MACHINERY CO., LTD., Hiroshima (JP)

(72) Inventors: Masatoshi Kozui, Hiroshima (JP); Yusuke Kamimura, Hiroshima (JP); Akira Kinoshita, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 247 days.

(21) Appl. No.: 15/924,661

(22) Filed: Mar. 19, 2018

(65) Prior Publication Data

US 2018/0274206 A1 Sep. 27, 2018

(30) Foreign Application Priority Data

Mar. 22, 2017 (JP) ..... 2017-055823

(51) Int. Cl.

| | |
|---|---|
| ***E02F 9/24*** | (2006.01) |
| ***E02F 9/20*** | (2006.01) |
| ***E02F 9/26*** | (2006.01) |
| ***E02F 9/12*** | (2006.01) |

(52) U.S. Cl.

CPC ..... *E02F 9/2033* (2013.01); *E02F 9/123* (2013.01); *E02F 9/24* (2013.01); *E02F 9/26* (2013.01); *E02F 9/262* (2013.01)

(58) Field of Classification Search

USPC ..... 701/50

See application file for complete search history.

(56) References Cited

U.S. PATENT DOCUMENTS 5,198,800 A * 3/1993 Tozawa ..... E02F 9/2033 212/276

2010/0264106 A1* 10/2010 Kawai ..... B66C 23/86 212/276

(Continued)

FOREIGN PATENT DOCUMENTS

EP 2 631 374 A1 8/2013

EP 2 757 782 A1 7/2014

(Continued)

OTHER PUBLICATIONS

Visual field assisting device of working machine, Ishimoto Hidefumi, Japanese Patent Publication No. JP 2010-059653A, English translation from Google Patents (Year: 2008).*

(Continued)

*Primary Examiner* — James M McPherson

(74) *Attorney, Agent, or Firm* — Oblon, McClelland, Maier & Neustadt, L.L.P.

(57) ABSTRACT

A control section determines a monitoring region, a region wherein an obstacle is to be monitored, the monitoring region not including the lower travelling body. The control section changes the monitoring region so as not to include the lower travelling body based on a turn angle detected by the turn angle detection section. The control section limits operation of at least one of travelling of the lower travelling body and turning of the upper slewing body when the obstacle detection section detects an obstacle being present in the monitoring region.

6 Claims, 15 Drawing Sheets

(56) References Cited

U.S. PATENT DOCUMENTS

| | | | | |
|---|---|---|---|---|
| 2013/0120577 | A1* | 5/2013 | Austefjord | B66C 13/02 348/148 |
| 2013/0222573 | A1* | 8/2013 | Onuma | E02F 9/24 348/82 |
| 2014/0354813 | A1* | 12/2014 | Ishimoto | H04N 7/181 348/148 |
| 2016/0016512 | A1* | 1/2016 | Masutani | B60R 1/00 340/435 |
| 2018/0209122 | A1* | 7/2018 | Kiyota | E02F 9/262 |

FOREIGN PATENT DOCUMENTS

| | | | | |
|---|---|---|---|---|
| JP | 2006-257724 | A | | 9/2006 |
| JP | 2007-023486 | | | 2/2007 |
| JP | 2010059653 | A | * | 3/2010 |
| KR | 20150027451 | A | * | 3/2015 |

OTHER PUBLICATIONS

Apparatus and method for prevent interference of work device of Excavator, Jin-Uk Kim, Korean Patent Application No. KR 20150027451A, English translation of specification from,espacenet.com (Year: 2013).*

Extended European Search Report dated Jul. 30, 2018 in Patent Application No. 18162200.2.

* cited by examiner

CONSTRUCTION MACHINE

TECHNICAL FIELD

The present invention relates to a construction machine.

BACKGROUND ART

Conventional construction machines are recited in, for example, Japanese Patent Unexamined Publication No. 2007-23486. The construction machine recited in the above patent literature includes a contact prevention control device for preventing an upper slewing body and an obstacle from contacting with each other under a condition where the obstacle is present in a region which is hard to be seen from an operator sitting on a driver's seat. When an obstacle is detected in a collision prevention region set around the upper slewing body, the contact prevention control device, which includes a millimeter wave radar as an obstacle detection section, forcedly stops operation of the upper slewing body. In other words, in the construction machine recited in the above literature, when an obstacle intrudes into a monitoring region around the construction machine (a collision prevention region in the above literature), operation of the construction machine in a direction in which the construction machine approaches the obstacle is limited.

SUMMARY OF INVENTION

With the technique recited in the above literature, even when a turn angle of an upper slewing body with respect to a lower travelling body is changed, the above monitoring region does not change. Therefore, when a turn angle changes, the lower travelling body might intrude into the monitoring region, so that the lower travelling body might be determined to be an obstacle. Therefore, operation of the construction machine might be limited more than necessary. Additionally, although determination that the lower travelling body is an obstacle can be avoided by narrowing the monitoring region, this might cause a failure in detecting an obstacle even when the obstacle is present in the vicinity of the lower travelling body. Therefore, the construction machine might contact the obstacle.

An object of the present invention is to provide a construction machine capable of suppressing erroneous determination of a lower travelling body as an obstacle even when a turn angle is changed and capable of detecting an obstacle being present in the vicinity of the lower travelling body.

The construction machine of the present invention includes a lower travelling body, an upper slewing body, a control section, a turn angle detection section, and an obstacle detection section. The upper slewing body is turnable with respect to the lower travelling body. The control section controls travelling of the lower travelling body, and turning of the upper slewing body with respect to the lower travelling body. The turn angle detection section detects a turn angle of the upper slewing body with respect to the lower travelling body to input the detected turn angle to the control section. The obstacle detection section is attached to the upper slewing body to detect an obstacle and input a detection result to the control section. The control section determines a monitoring region in which an obstacle is to be monitored, the monitoring region not including the lower travelling body. The control section changes the monitoring region so as not to include the lower travelling body in the monitoring region, based on the turn angle detected by the turn angle detection section. The control section limits operation of at least one of travelling of the lower travelling body and turning of the upper slewing body when the obstacle detection section detects an obstacle being present in the monitoring region.

DESCRIPTION OF EMBODIMENTS

First Embodiment

Figure 1:
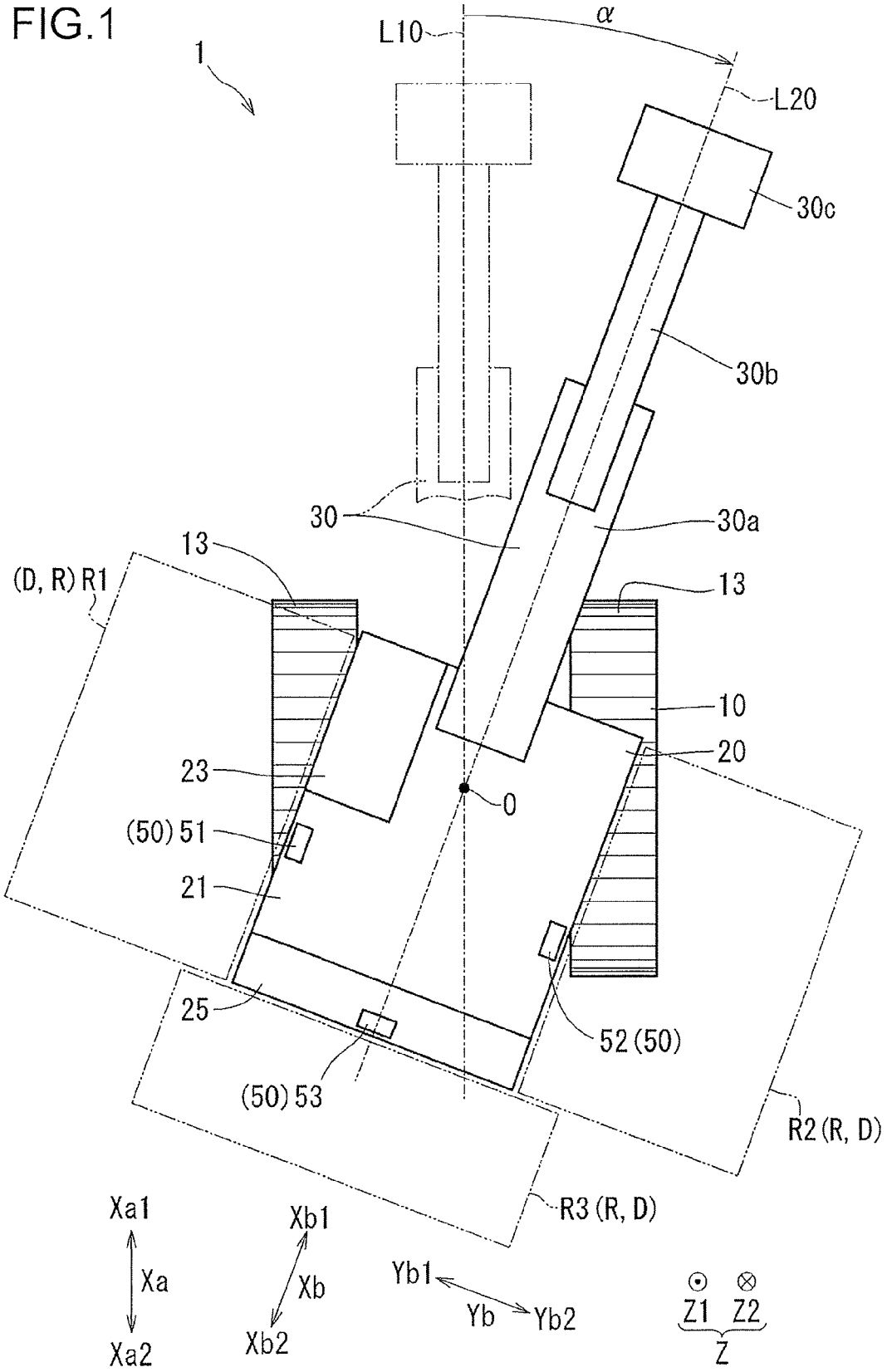
FIG. 1 is a view of a construction machine seen from above.

With reference to FIGS. 1 to 9, a construction machine 1 of a first embodiment will be described.

The construction machine 1, which is a machine that conducts work such as construction work and is a machine that conducts work such as digging work, is, for example, a shovel, or a hydraulic excavator. The construction machine 1 includes a lower travelling body 10, an upper slewing body 20, an upper attachment 30, and a control system 40 (see FIG. 2).

Figure 5:
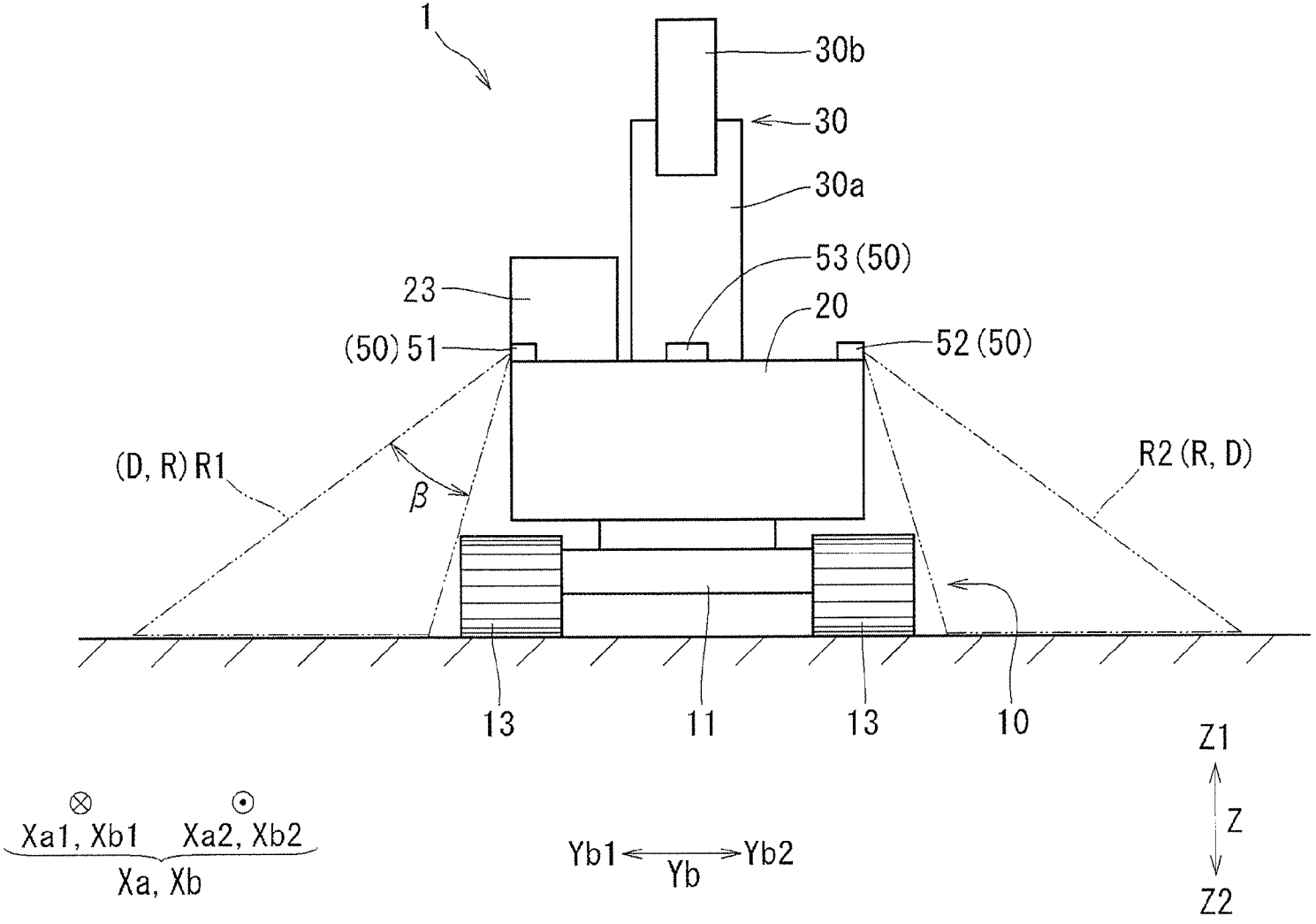
FIG. 5 is a view of the construction machine shown in FIG. 1 seen from an upper slewing body rear side Xb2.

The lower travelling body 10 is a part of the construction machine 1 which travels on the ground. As shown in FIG. 5, the lower travelling body 10 includes a lower main body 11 (a main body portion), and a pair of right and left crawlers 13. To the lower main body 11, a lower attachment (structure) such as a dozer may be attached in some cases. The lower attachment is included in the lower travelling body 10. The right and left crawlers 13 are attached to a left side portion and a right side portion of the lower main body 11. As shown in FIG. 1, directions in which the respective crawlers 13 extend are considered to be a lower travelling body front-rear direction Xa. In the lower travelling body front-rear direction Xa, one side (or one direction) is considered to be a lower travelling body front side Xa1 and an opposite side thereto is considered to be a lower travelling body rear side Xa2. An actuator which operates each of the pair of right and left crawlers 13, for example, a travelling motor formed with a hydraulic motor, is provided in a part of the lower travelling body 10 on the lower travelling body rear side Xa2.

The upper slewing body 20 is attached to the lower travelling body 10 so as to be turnable around a center of turn O with respect to the lower travelling body 10. The lower travelling body 10 is provided with a turning device which rotatably supports the upper slewing body 20. The upper slewing body 20 includes an upper main body 21, a cabin 23, and a counter weight 25. The upper attachment 30 is attached to the upper slewing body 20. The upper attachment 30 and the counter weight 25 are located to be spaced apart in an upper slewing body front-rear direction Xb. A direction of a rotation axis of the upper slewing body 20 with respect to the lower travelling body 10 is set to be an up-down direction Z. In the up-down direction Z, a side (or a direction) directing from the lower travelling body 10 toward the upper slewing body 20 is set to be an upper side Z1 and a side opposite thereto is set to be a lower side Z2. A side orthogonal to the up-down direction Z and directing from the counter weight 25 to the upper attachment 30 is set to be an upper slewing body front side Xb1 in the upper slewing body front-rear direction Xb, and a side opposite thereto is set to be an upper slewing body rear side Xb2 in the upper slewing body front-rear direction Xb. A direction orthogonal to the up-down direction Z and to the upper slewing body front-rear direction Xb is set to be an upper slewing body lateral direction Yb. In the upper slewing body lateral direction Yb, a left side when viewed from the upper slewing body rear side Xb2 to the upper slewing body front side Xb1 is set to be an upper slewing body left side Yb1, and a right side is set to be an upper slewing body right side Yb2.

The upper main body 21 is a main body part of the upper slewing body 20. The upper main body 21 is mounted with a device such as an engine (not shown). The cabin 23 is a part in which an operator (an operator of the construction machine 1) drives the construction machine 1 (when expressed in a different way, a chamber or a section). For example, the cabin 23 is attached to an outer side part of the upper main body 21 in the upper slewing body lateral direction Yb (e.g. the upper slewing body left side Yb1 part), which part is also an upper slewing body front side Xb1 part of the upper main body 21. The counter weight 25 is a weight for balancing mass of the construction machine 1 in the upper slewing body front-rear direction Xb. The counter weight 25 is attached to an upper slewing body rear side Xb2 part of the upper main body 21. The upper attachment 30 is a device attached to, for example, the upper slewing body front side Xb1 part of the upper main body 21 for conducting work such as digging work. For example, the upper attachment 30 includes a boom 30*a*, an arm 30*b*, and a bucket 30*c*.

Figure 2:
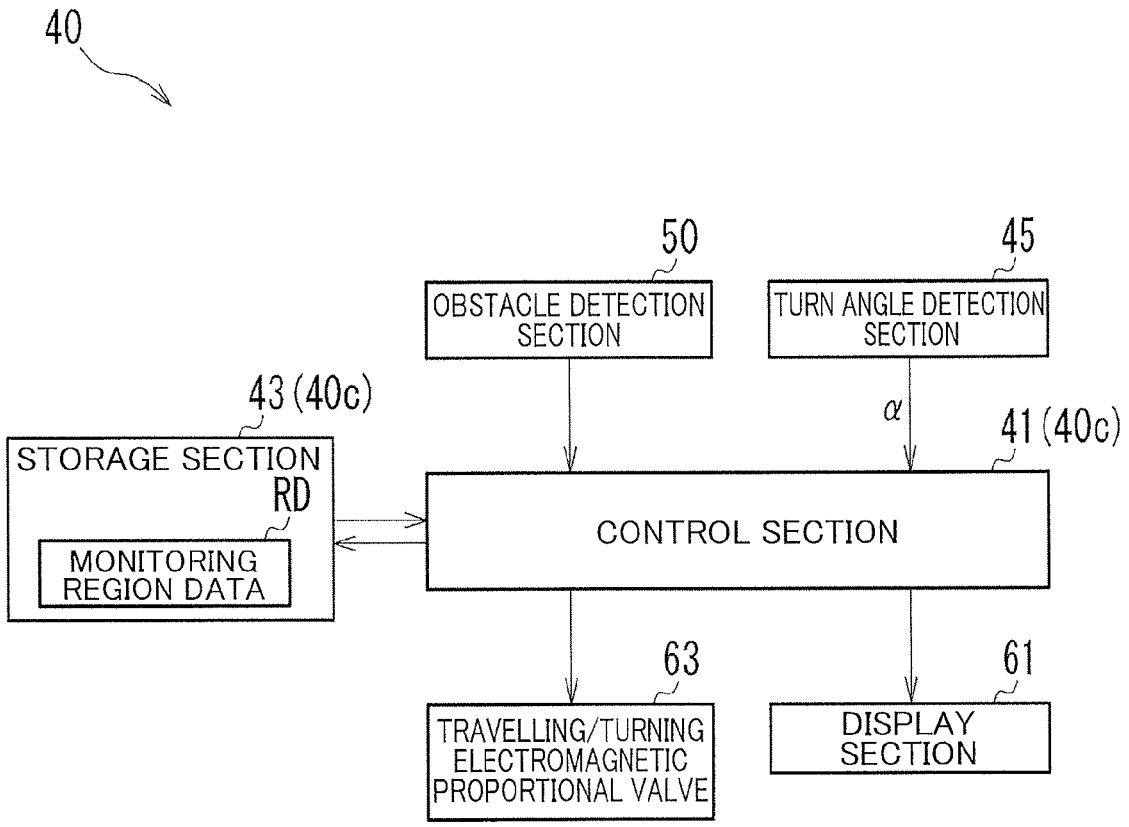
FIG. 2 is a block diagram showing a control system provided in the construction machine shown in FIG. 1.

The control system 40 (control line) (see FIG. 2) detects an obstacle around the construction machine 1 to limit operation of the construction machine 1. As shown in FIG. 2, the control system 40 includes a controller 40*c* (computation unit), a turn angle detection section 45, an obstacle detection section 50, a display section 61, and an electromagnetic proportional valve 63. The controller 40*c* includes a control section 41 and a storage section 43.

The control section 41 conducts input and output, computation (calculation, determination, etc.), control, and the like. The control section 41 controls travelling of the lower travelling body 10 (see FIG. 1), and turning of the upper slewing body 20 (see FIG. 1) with respect to the lower travelling body 10.

The storage section 43 stores information. The storage section 43 is a memory region of the controller 40*c*. The storage section 43 stores data (e.g. structure data, design data, and lower travelling body information) related to a structure of the lower travelling body 10 (sec FIG. 1). The storage section 43 stores a plurality of monitoring region data pieces RD as data related to a monitoring region R below.

As shown in FIG. 1, the turn angle detection section 45 detects a turn angle α of the upper slewing body 20 with respect to the lower travelling body 10. The turn angle α is an angle (e.g. clockwise rotation angle) of a line segment L20 to a line segment L10 when viewed from the up-down direction Z. The line segment L10 extends from the center of turn O to the lower travelling body front side Xa1. The line segment L20 extends from the center of turn O to the upper slewing body front side Xb1. The turn angle detection section 45 shown in FIG. 5 is an angle sensor. The turn angle detection section 45 inputs a detection result (a detected turn angle α) to the control section 41.

As shown in FIG. 1, the obstacle detection section 50 detects an object around the construction machine 1. The obstacle detection section 50 is capable of detecting an obstacle (when expressed in a different way, a detection target or a sensing target) in the monitoring region R. The obstacle detection section 50 is attached to the upper slewing body 20, for example, to an upper surface of the upper slewing body 20 (a surface on the upper side Z1). The obstacle detection section 50 may be attached to a side surface of the upper slewing body 20 (an outer side surface in the upper slewing body lateral direction Yb) or may be attached to a rear surface of the upper slewing body 20 (a surface on the upper slewing body rear side Xb2). As shown in FIG. 5, the obstacle detection section 50 is arranged more to the upper side Z1 than the lower travelling body 10.

Figure 4:
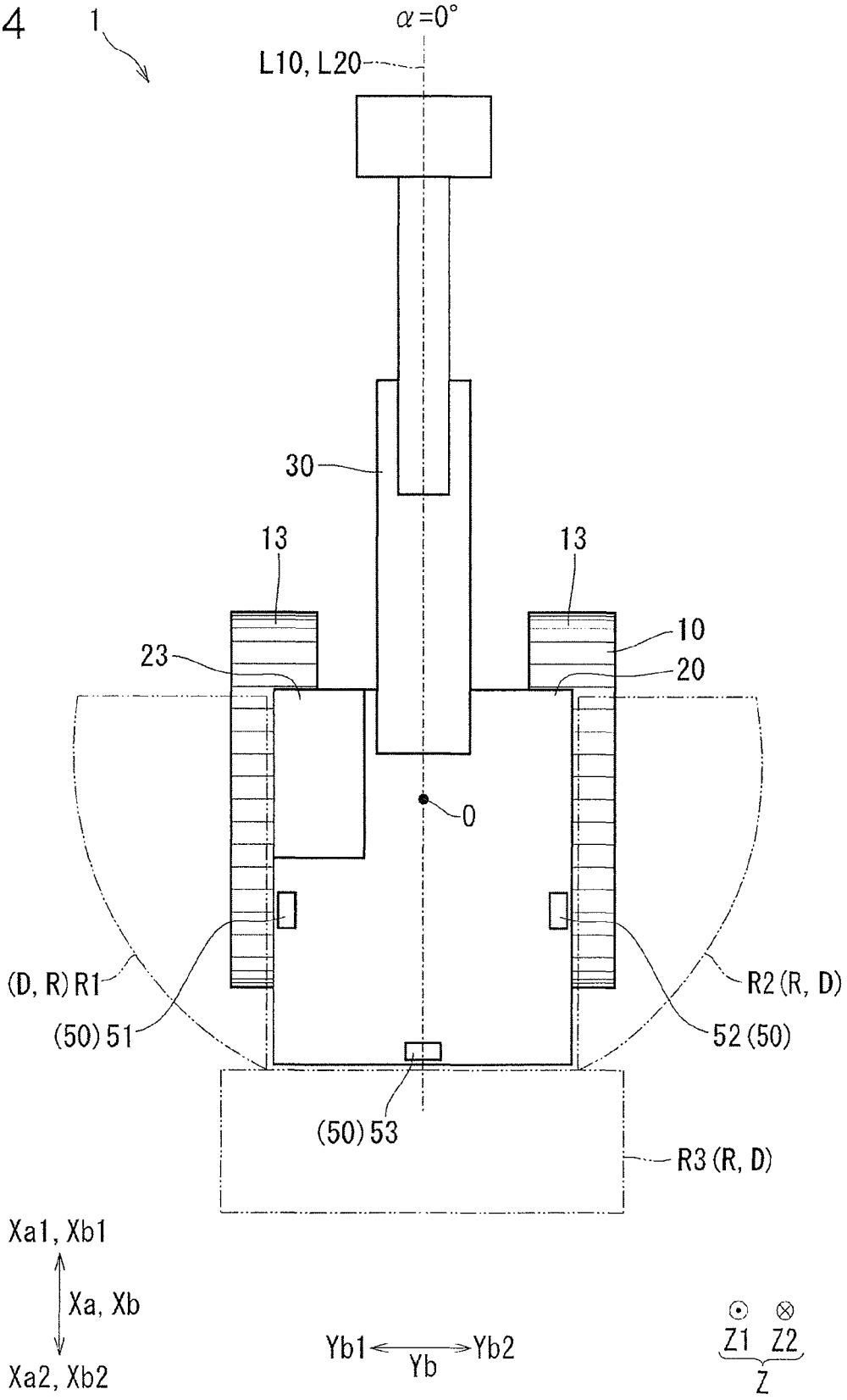
FIG. 4 is a view corresponding to FIG. 1, in which view a turn angle α shown in FIG. 1 is 0°.

As shown in FIG. 4, the obstacle detection section 50 includes sensors provided at, for example, three positions, that is, a left side sensor 51, a right side sensor 52, and a rear side sensor 53. The left side sensor 51, the right side sensor 52, and the rear side sensor 53 are each a ranging sensor. The left side sensor 51, the right side sensor 52, and the rear side sensor 53 are each an optical sensor, for example, an infrared sensor, or a sensor using laser light. The left side sensor 51, the right side sensor 52, and the rear side sensor 53 are each a sensor which calculates a distance from an irradiation device to an object based on time from when the irradiation device radiates light to when light reflected by a ranging target is caught by a light receiving device. The left side sensor 51, the right side sensor 52, and the rear side sensor 53 are each a three-dimensional ranging sensor, which is a sensor capable of obtaining an image and a distance. The left side sensor 51, the right side sensor 52, and the rear side sensor 53 are each, for example, an infrared laser ranging sensor, or an infrared time of flight (TOF) sensor. The left side sensor 51, the right side sensor 52, and the rear side sensor 53 each input a detection result (an image and a distance) to the control section 41 (see FIG. 2).

The left side sensor 51 is attached to an end portion on the upper slewing body left side Yb1 of the upper main body 21. An end portion represents an end and a part surrounding thereof (the same hereinafter). The right side sensor 52 is attached to an end portion on the upper slewing body right side Yb2 of the upper main body 21. The rear side sensor 53 is attached to an end portion on the upper slewing body rear side Xb2 of the upper slewing body 20, for example, attached to an end portion on the upper slewing body rear side Xb2 of the counter weight 25 (see FIG. 1). The number and arrangement of sensors forming the obstacle detection section 50 can be modified.

The display section 61 displays information such as a detection result of the obstacle detection section 50 shown in FIG. 2. The display section 61, which is arranged, for example, in the cabin 23 (see FIG. 1), is, for example, an instrument display. The display section 61 displays information according to a command input from the control section 41.

The electromagnetic proportional valve 63 is a valve which controls operation of the construction machine 1 (see FIG. 1). The electromagnetic proportional valve 63 includes a valve which controls travelling of the lower travelling body 10 (see FIG. 1), and a valve which controls turning of the upper slewing body 20 (see FIG. 1) with respect to the lower travelling body 10. The electromagnetic proportional valve 63 operates according to a command input from the control section 41.

(Operation)

Figure 3:
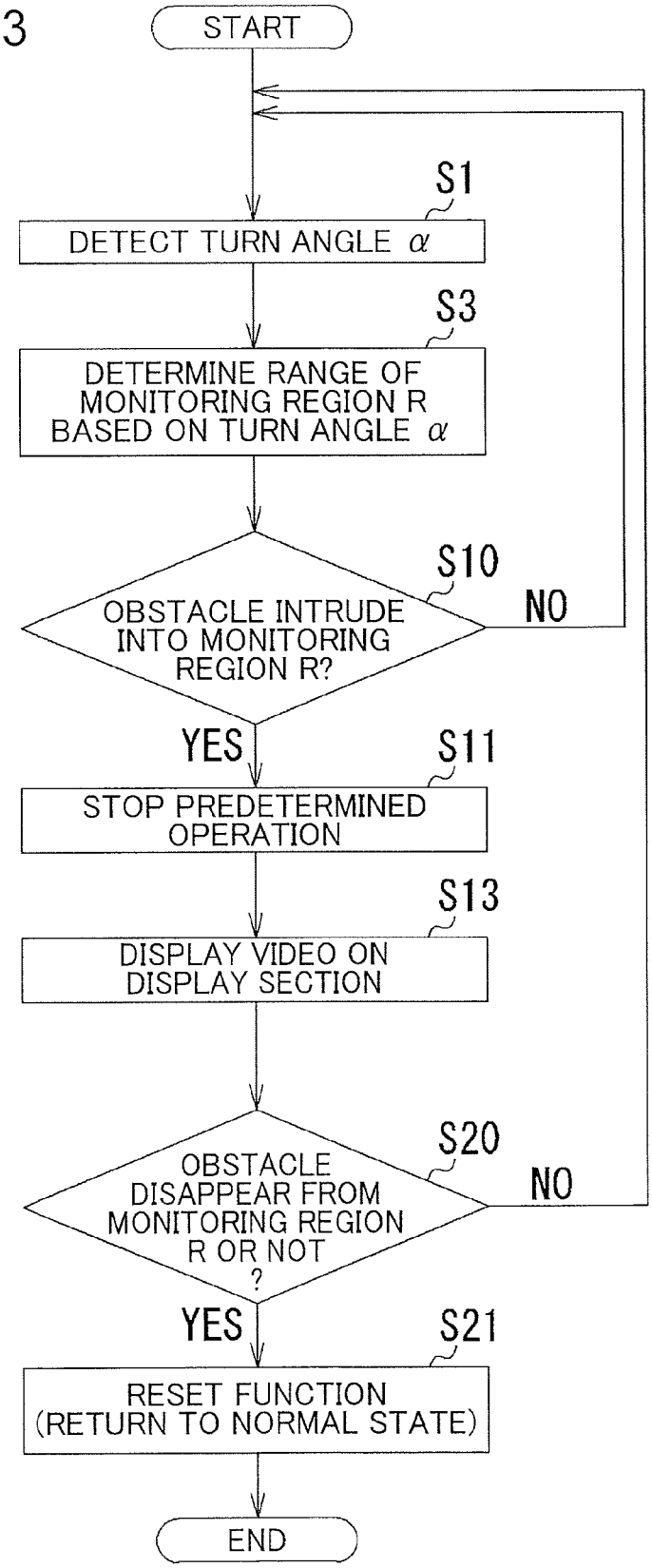
FIG. 3 is a flow chart of operation of the construction machine shown in FIG. 1.

With reference to the flow chart shown in FIG. 3, operation of the construction machine 1 (see FIG. 1) will be described. In Step S1, the turn angle detection section 45 shown in FIG. 2 detects the turn angle α and inputs a detection result to the control section 41.

In Step S3 (see FIG. 3), the control section 41 determines a range of the monitoring region R shown in FIG. 1 based on the turn angle α. Details of this step are as follows.

(Monitoring Region R)

The monitoring region R is a region in which an obstacle is to be monitored by the construction machine 1. The monitoring region R, when expressed in a different way, is an obstacle monitoring region, an obstacle sensing region, or a contact prevention region. In a case where an obstacle is present in the monitoring region R, when the construction machine 1 operates, the construction machine 1 might collide (or contact) with the obstacle. The monitoring region R is determined (or set) at a position and in a range which enable suppression of such collision.

The monitoring region R is included in a detection-allowed region D which is a region in which the obstacle detection section 50 is allowed to detect an object. The monitoring region R may be equal to the detection-allowed region D or be narrower than the detection-allowed region D (e.g. see a second embodiment).

The monitoring region R is set in the surrounding of the construction machine 1 and is set in the vicinity of the construction machine 1. The monitoring region R is set to be a region that cannot be visually checked directly by an operator in the cabin 23. The monitoring region R can be set to be a region that can be visually checked directly by an operator. The monitoring region R is divided into, for example, a left side monitoring region R1, a right side monitoring region R2, and a rear side monitoring region R3. The left side monitoring region R1 is the monitoring region R located more to the upper slewing body left side Yb1 than the upper slewing body 20 and is a region in which object detection is conducted by the left side sensor 51. The left side monitoring region R1 can be equal to a region in which object detection is conducted by the left side sensor 51 or be narrower than the region. The right side monitoring region R2 is the monitoring region R located more to the upper slewing body right side Yb2 than the upper slewing body 20 and is a region in which object detection is conducted by the right side sensor 52. The right side monitoring region R2 can be equal to a region in which object detection is conducted by the right side sensor 52 or be narrower than the region. The rear side monitoring region R3 is the monitoring region R located more to the upper slewing body rear side Xb2 than the upper slewing body 20 and is a region in which object detection is conducted by the rear side sensor 53. The rear side monitoring region R3 can be equal to a region in which object detection is conducted by the rear side sensor 53 or be narrower than the region.

Each monitoring region R, that is, each of the left side monitoring region R1, the right side monitoring region R2, and the rear side monitoring region R3 does not include the lower travelling body 10 as shown in FIG. 5. Expressed in a different way, the lower travelling body 10 is excluded from the monitoring region R. The monitoring region R does not include the pair of right and left crawlers 13. Expressed in a different way, the lower travelling body 10 is excluded from the monitoring region R. When a structure is attached to the lower main body 11, the structure attached to the lower main body 11 is not included in the monitoring region R. At least a part of the monitoring region R is set to be more to the lower side Z2 than an upper surface of the upper slewing body 20 (i.e. a surface on which the obstacle detection section 50 is provided). The monitoring region R is set to be more to the upper side Z1 than the ground, that is set to be at the foot of the construction machine 1. The monitoring region R is preferably set such that other part than the lower travelling body 10 is as wide as possible. The monitoring region R is preferably set such that a range detectable by the obstacle detection section 50 can be made use of as much as possible.

(Change of Monitoring Region R)

Figure 7:
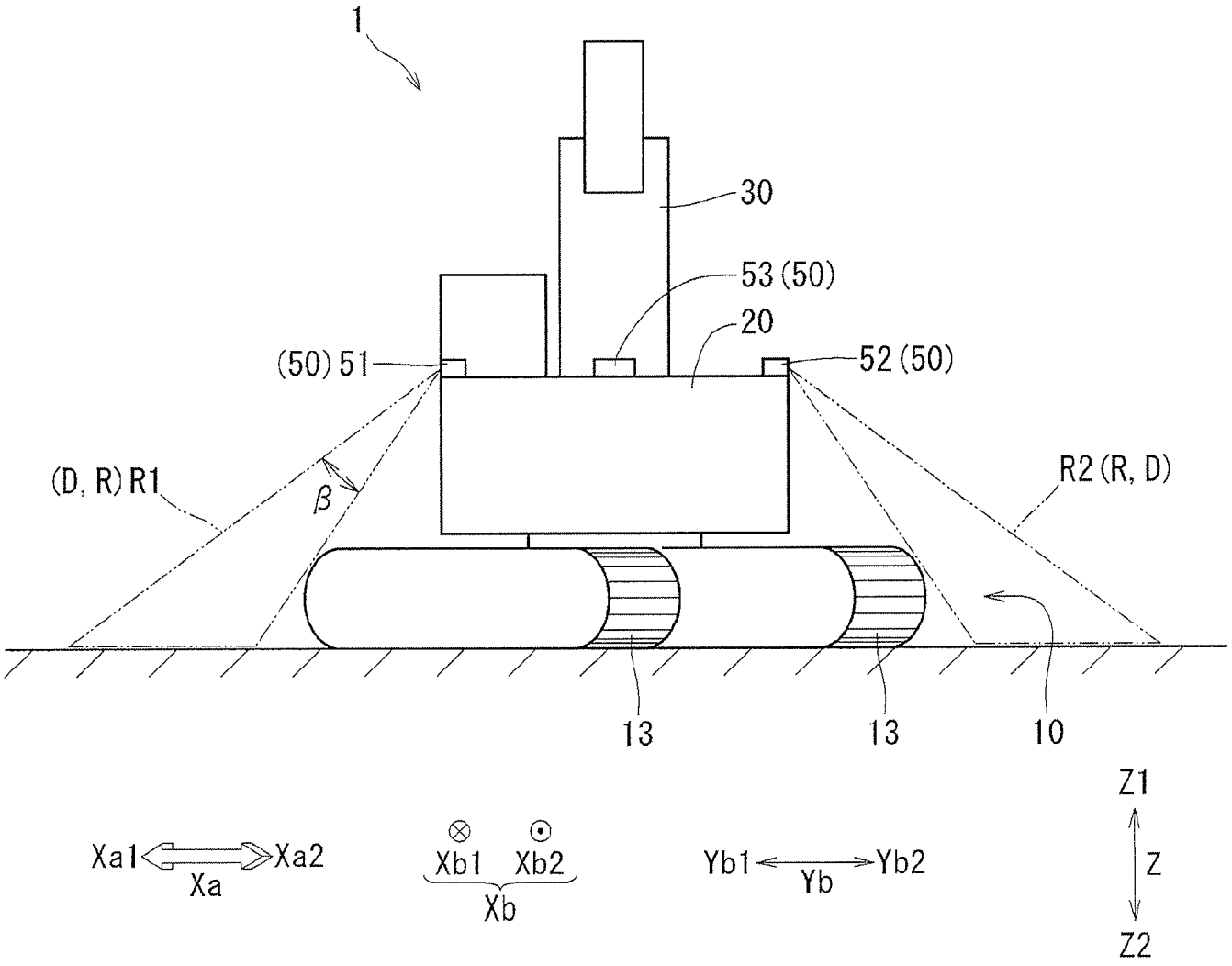
FIG. 7 is a view corresponding to FIG. 5, in which view the turn angle α shown in FIG. 1 is 45°.
Figure 9:
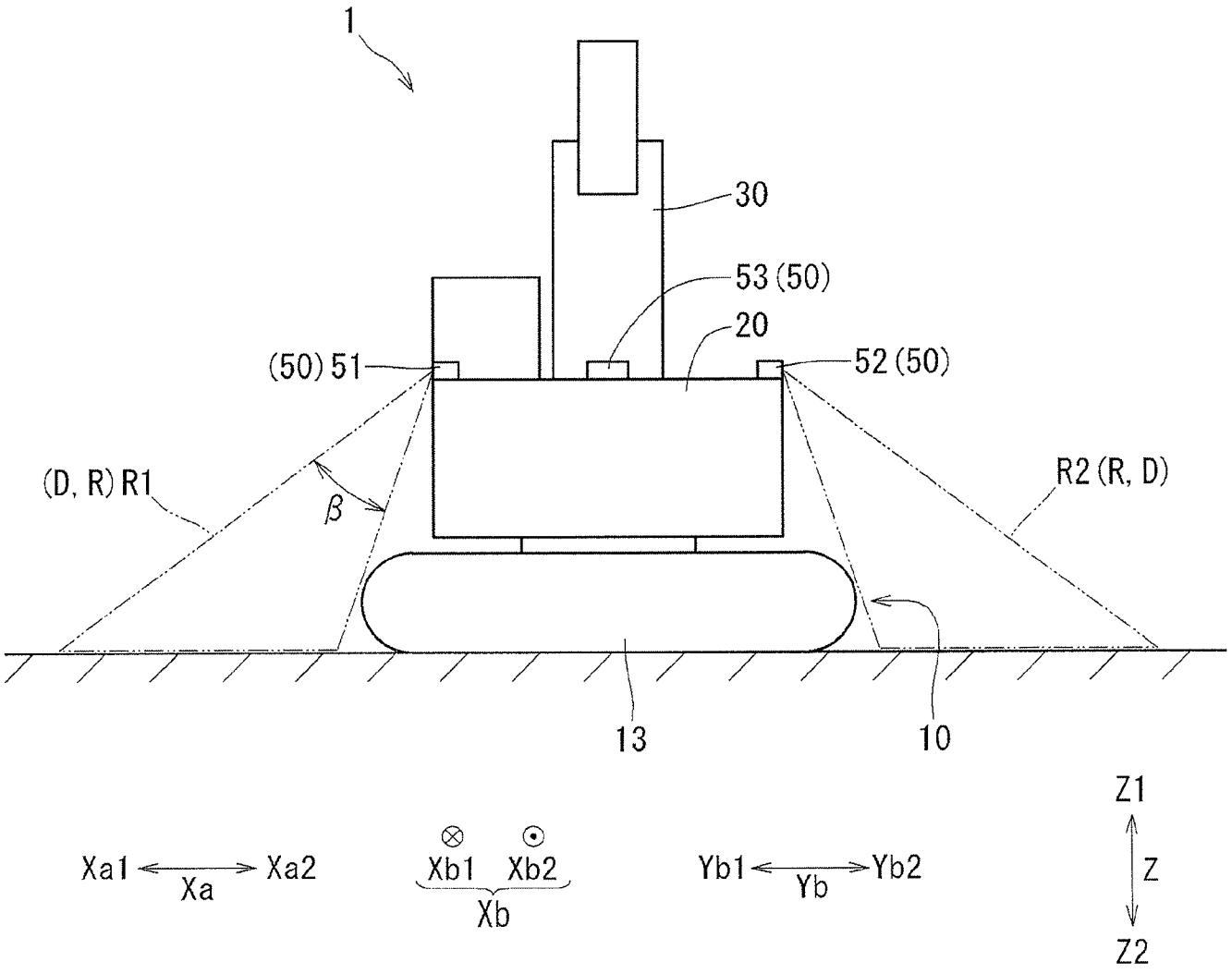
FIG. 9 is a view corresponding to FIG. 5, in which view the turn angle α shown in FIG. 1 is 90°.

The control section 41 shown in FIG. 2 changes the monitoring region R based on the turn angle α (see FIG. 5). The control section 41 changes the monitoring region R such that at whichever turn angle α, the lower travelling body 10 (see FIG. 1) is not included in the monitoring region R. In other words, the control section 41 changes the monitoring region R such that at whichever turn angle α, the lower travelling body 10 is excluded from the monitoring region R. As shown in FIGS. 5, 7, and 9, the control section 41 (see FIG. 2, the same hereinafter with respect to the control section 41) changes an angle of view β to thereby changing the monitoring region R, the angle of view β indicating a range of an image obtained by the obstacle detection section 50. More specifically, by changing a position of a lower edge of an image obtained by the obstacle detection section 50, the monitoring region R is changed. The angle of view β is set individually for each of the left side sensor 51, the right side sensor 52, and the rear side sensor 53. The control section 41 may change the angle of view β, for example, by processing (image processing etc.) an image obtained by the obstacle detection section 50 so as to exclude a part of the image from a determination target and changing a range to be excluded. The control section 41 shown in FIG. 2 changes the monitoring region R (see FIG. 5) every time the turn angle α changes by a predetermined angle (e.g. one degree, two degrees, or three degrees). The predetermined angle (i.e. steps) is set (or stored) at, for example, the storage section 43 in advance.

In other words, the control section includes a monitoring region changing section which changes the monitoring region such that the lower travelling body is not included in the monitoring region based on the turn angle detected by the turn angle detection section.

(Determination of Monitoring Region R Based on Monitoring Region Data RD)

The storage section 43 stores the plurality of monitoring region data pieces RD in advance. For example, the storage section 43 stores the plurality of monitoring region data pieces RD at the time of factory shipment of the construction machine 1 (see FIG. 1). The plurality of monitoring region data pieces RD are data for determining the monitoring region R (see FIG. 1). In other words, the plurality of monitoring region data pieces RD include data for determining the left side monitoring region R1, data for determining the right side monitoring region R2, and data for determining the rear side monitoring region R3. The plurality of monitoring region data pieces RD are data which define a relationship between the turn angle α and the monitoring region R. For example, in a case where every time the turn angle α changes by one degree, the control section 41 changes the monitoring region R, the storage section 43 stores the plurality of monitoring region data pieces for 360 degrees in advance. The plurality of monitoring region data pieces RD are set based on a structure (e.g. specifications such a width, a length, and a shape) of the lower travelling body 10 (see FIG. 1). The plurality of monitoring region data pieces RD are data related to how the lower travelling body 10 is seen from the obstacle detection section 50 (see FIG. 1). In other words, in the present embodiment, the storage section 43 includes, as the plurality of monitoring region data pieces RD, data related to a position and a range of the lower travelling body 10 in an image obtained by the left side sensor 51, data related to a position and a range of the lower travelling body 10 in an image obtained by the right side sensor 52, and data related to a position and a range of the lower travelling body 10 in an image obtained by the rear side sensor 53. These pieces of data are stored for predetermined angles, respectively. The control section 41 reads a monitoring region data piece RD stored in the storage section 43 based on the turn angle α, and determines the monitoring region R based on the read monitoring region data piece RD. Thus, making the controller 40*c* learn the monitoring region R (i.e. the monitoring region data RD) in advance results in using the monitoring region R as off-line information, and as an internal program.

(Relationship Between Turn Angle α and Monitoring Region R)

A specific example of a relationship between the turn angle α and the monitoring region R shown in FIG. 1 is as follows. The relationship between the turn angle α and the monitoring region R and a shape of the monitoring region R can be changed.

In a case where the turn angle α is 0° (including approximately 0°; the same with respect to the following numerical values), the monitoring region R (specifically, the left side monitoring region R1, the right side monitoring region R2, and the rear side monitoring region R3) is set in such a manner as, for example, shown in FIGS. 4 and 5. When the turn angle α is 0° as shown in FIG. 4, the lower travelling body 10 never travel in the upper slewing body lateral direction Yb. On the other hand, when the upper slewing body 20 turns around the center of turn O as a center, the upper slewing body 20 and an obstacle might contact with each other. Thus, when viewed from the up-down direction Z, an end portion on the upper slewing body left side Yb1 of the left side monitoring region R1, and an end portion on the upper slewing body right side Yb2 of the right side monitoring region R2 are set to be arc-shaped with the center of turn O as a center (or an approximate center). When viewed from the up-down direction Z, the rear side monitoring region R3 is set, for example, to be rectangular, and be a rectangle long in the upper slewing body lateral direction Yb. Among the left side monitoring region R1, the right side monitoring region R2, and the rear side monitoring region R3, two or more regions may overlap (the same occurs in a case where the turn angle α is other than 0°). Additionally, the monitoring region R in a case where the turn angle α is 180° is set similarly to the monitoring region R in a case where the turn angle α is 0°.

Figure 6:
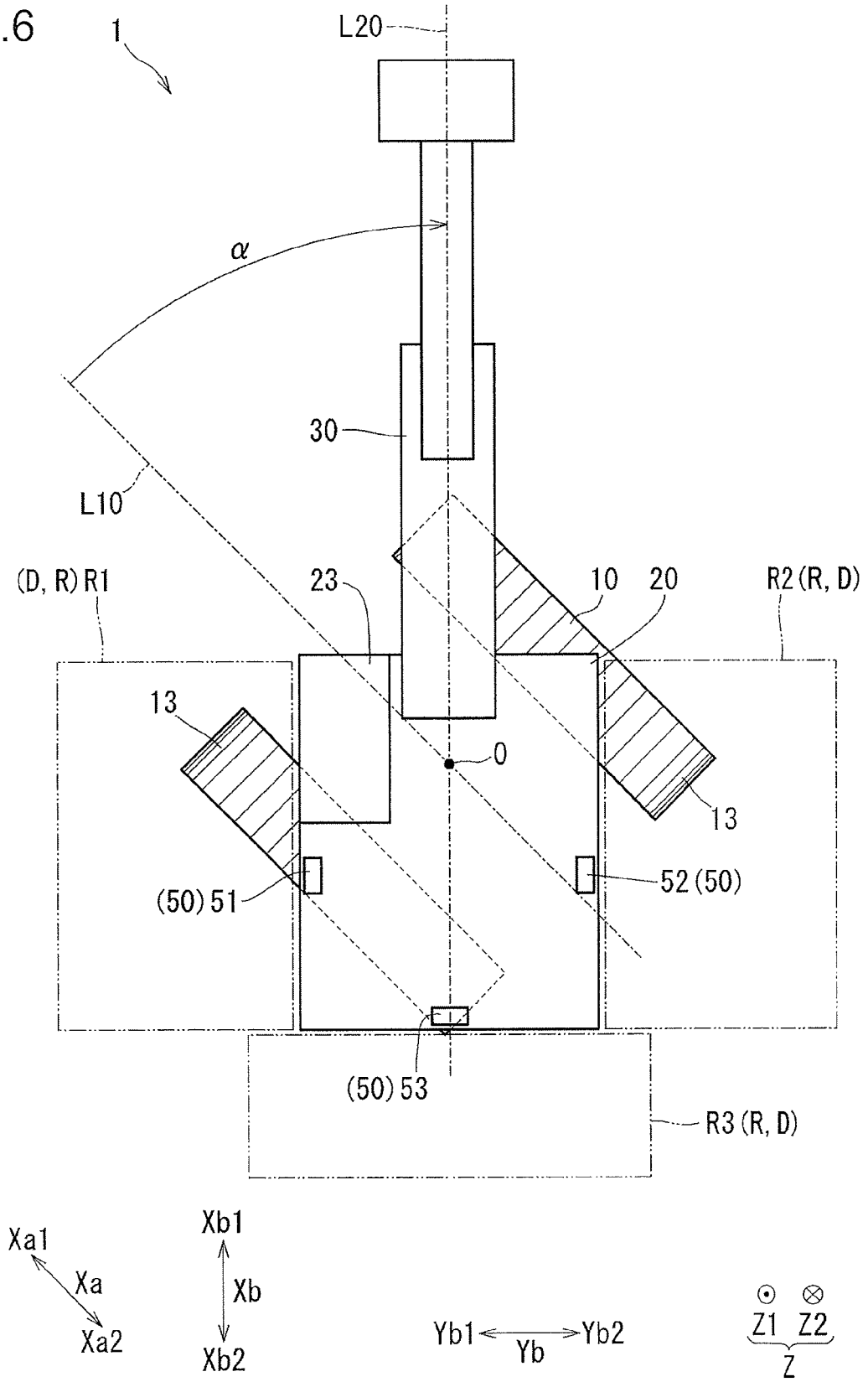
FIG. 6 is a view corresponding to FIG. 1, in which view the turn angle α shown in FIG. 1 is 45°.

When the turn angle α is other than 0° and other than 180°, the monitoring region R is set in a manner as shown, for example, in FIGS. 6 and 7. FIGS. 6 and 7 show an example where the turn angle α shown in FIG. 6 is 45°. When the turn angle α is other than 0° and other than 180°, the lower travelling body 10 might travel in the upper slewing body lateral direction Yb. Therefore, when viewed from the up-down direction Z, the left side monitoring region R1 and the right side monitoring region R2 are each set, for example, to be rectangular, and be a rectangle long in the upper slewing body front-rear direction Xb. In other words, the left side monitoring region R1 and the right side monitoring region R2 have shapes thereof changed according to the turn angle α when viewed from the up-down direction Z. The control section includes a monitoring region shape changing section which changes a shape of the monitoring region R seen from the up-down direction Z according to the turn angle α. In a case where the turn angle α is other than 0° and other than 180°, the lower travelling body 10 more largely protrudes in the upper slewing body lateral direction Yb than the upper slewing body 20 in a case where the turn angle α is 0° or 180° (see FIG. 4). Thus, as shown in FIG. 7, the angle of view β in a case where the turn angle α is other than 0° and other than 180° is set to be narrower than the angle of view β (see FIG. 5) in a case where the turn angle α is 0° or 180°.

In Step S10 (see FIG. 3), the control section 41 determines whether the obstacle detection section 50 has detected (or caught) an obstacle in the monitoring region R shown in FIG. 1 or not (when expressed in a different way, an obstacle has intruded into the monitoring region R). Specifically, the control section 41 determines whether an obstacle is present in any of the left side monitoring region R1, the right side monitoring region R2, and the rear side monitoring region R3 or not. Presence/absence of an obstacle in the left side monitoring region R1 is detected by the left side sensor 51, presence/absence of an obstacle in the right side monitoring region R2 is detected by the right side sensor 52, and presence/absence of an obstacle in the rear side monitoring region R3 is detected by the rear side sensor 53. When the obstacle detection section 50 detects an obstacle being in the monitoring region R, the processing proceeds to Step S11 (see FIG. 3). When the obstacle detection section 50 fails to detect presence of an obstacle in the monitoring region R, the processing returns to Step S1 (see FIG. 3).

In Step S11 (see FIG. 3), the control section 41 limits predetermined operation of the construction machine 1. "Predetermined operation" is at least one of travelling of the lower travelling body 10 (hereinafter simply referred to also as travelling) and turning of the upper slewing body 20 (hereinafter simply referred to also as turning). At this time, the control section 41 limits, of the operation of the construction machine 1, operation which might cause the construction machine 1 and an obstacle to contact with each other. Limiting of the operation is, for example, stopping of operation. Limiting of the operation may be, for example, limiting an operation speed (e.g. limiting to a low speed) to an extent that prevents normal work. Limiting the operation may be, for example, limiting an operation force to an extent that prevents normal work.

In other words, the control section includes an operation limiting section which limits operation of at least one of travelling of the lower travelling body and turning of the upper slewing body when the obstacle detection section detects an obstacle in the monitoring region.

(Relationship Between Position of Obstacle and Limiting of Operation)

The control section 41 changes a kind (travelling, turning) of operation to be limited according to a position in the monitoring region R from which an obstacle has been detected, and according to the turn angle α. The control section 41 changes a kind of operation to be limited according to from which region of the left side monitoring region R1, the right side monitoring region R2, and the rear side monitoring region R3, an obstacle has been detected. In other words, the control section includes a to-be-limited operation changing section which changes a kind of operation to be limited based on a position in the monitoring region from which an obstacle has been detected, and the turn angle α. A specific example of a relationship among the turn angle α, a region from which an obstacle has been detected, and a kind of operation to be limited is shown in Table 1. This relationship can be changed.

TABLE 1

| | OPERATION TO BE LIMITED | | |
|---|---|---|---|
| ANGLE α | OBSTACLE INTRUDES ONTO LOWER TRAVELLING BODY | OBSTACLE INTRUDES INTO R1 OR R2 | OBSTACLE INTRUDES INTO R3 |
| 0° | TURNING, TRAVELLING | TURNING | TURNING, BACKWARD TRAVELLING |
| 0° < α < 90° | TURNING, TRAVELLING | TURNING, TRAVELLING | TURNING, BACKWARD TRAVELLING |
| 90° | TURNING, TRAVELLING | TURNING, TRAVELLING | TURNING |
| 900° < α < 180° | TURNING, TRAVELLING | TURNING, TRAVELLING | TURNING, BACKWARD TRAVELLING |
| 180° | TURNING, TRAVELLING | TURNING | TURNING, BACKWARD TRAVELLING |
| 180° < α < 270° | TURNING, TRAVELLING | TURNING, TRAVELLING | TURNING, BACKWARD TRAVELLING |
| 270° | TURNING, TRAVELLING | TURNING, TRAVELLING | TURNING |
| 270° < α < 360° | TURNING, TRAVELLING | TURNING, TRAVELLING | TURNING, BACKWARD TRAVELLING |

In a case where in at least one of the left side monitoring region R1, the right side monitoring region R2, and the rear side monitoring region R3 shown in FIG. 1, and an obstacle is present on the lower travelling body 10, the control section 41 limits turning and travelling irrespective of the turn angle α.

In a case where at least either one of the left side monitoring region R1 and the right side monitoring region R2 has an obstacle (referred to as "case C1"), the control section 41 limits the operation in a manner as follows. In the above "case C1", when the turn angle α is 0° (see FIG. 4) or 180°, that is, when the lower travelling body front side Xa1 and the upper slewing body front side Xb1 are in the same direction (including the approximately same direction) or in opposite directions (including approximately opposite directions), the control section 41 limits turning. In the above "case C1", when the turn angle α is other than 0° and other than 180° (see FIG. 6), the control section 41 limits turning and travelling.

When the rear side monitoring region R3 has an obstacle (referred to as "case C3"), the control section 41 limits the operation in a manner as follows. In the above "case C3", when the turn angle α is 90° (see FIG. 8) or 270°, that is, when the lower travelling body front side Xa1 and the upper slewing body front side Xb1 are at right angles (including the approximately right angles), the control section 41 limits turning. In the above "case C3", when the turn angle α is other than 90° and other than 270° (see e.g. FIG. 6), the control section 41 limits travelling (specifically, backward travelling) and turning to the upper slewing body rear side Xb2. Backward travelling includes moving of the upper slewing body 20 diagonally to the upper slewing body rear side Xb2. Additionally, in a case, for example, where a plurality of obstacles is present, the obstacles might be detected in a plurality of regions.

In Step S13 (see FIG. 3), the control section 41 shown in FIG. 2 causes the display section 61 to display video. At this time, the display section 61 displays video including an obstacle in the monitoring region R (see FIG. 1). For example, the display section 61 displays infrared video. For example, the display section 61 displays video of a region from which an obstacle has been detected among the left side monitoring region R1, the right side monitoring region R2, and the rear side monitoring region R3.

In Step S20 (see FIG. 3), the control section 41 determines whether from the monitoring region R shown in FIG. 1, an obstacle disappears or not (when expressed in a different way, the obstacle detection section 50 fails to detect an obstacle in the monitoring region R or not). Specifically, the control section 41 determines whether an obstacle disappears or not from each of the left side monitoring region R1, the right side monitoring region R2, and the rear side monitoring region R3. When the obstacle detection section 50 detects an obstacle in the monitoring region R, the processing returns to Step S1 (see FIG. 3). When the obstacle detection section 50 fails to detect an obstacle in the monitoring region R (when expressed in a different way, when the obstacle disappears), the processing proceeds to Step S21 (see FIG. 3).

In Step S21 (see FIG. 3), the control section 41 releases limiting of the operation (when expressed in a different way, resets the function). As a result, the construction machine 1 conducts normal operation to return to a state where normal work is allowed.

(Change of Specification of Lower Travelling Body 10)

There are some cases where, for example, at an operation site (construction site, execution site) of the construction machine 1 shown in FIG. 1, specifications of the lower travelling body 10 are changed. There are, for example, a case where the lower attachment is attached to the lower main body 11, a case where the lower attachment is detached from the lower main body 11, and a case where a kind of the lower attachment is changed. When the specification of the lower travelling body 10 is changed, how the lower travelling body 10 is seen from the obstacle detection section 50 and a distance therebetween are changed. Specifically, how the lower travelling body 10 is seen from each of the left side sensor 51, the right side sensor 52, and the rear side sensor 53, and a distance therebetween are changed. It is therefore necessary to change the monitoring region R according to presence/absence and a kind of the lower attachment. Thus, the storage section 43 shown in FIG. 2 stores the monitoring region data RD in advance with respect to each of presence/absence and a kind of a structure attachable to the lower main body 11 (see FIG. 5). In other words, the storage section 43 stores, as the plurality of monitoring region data pieces RD, data in a case where no structure is attached to the lower main body 11, and data according to a kind of a structure attached to the lower main body 11. When expressed in a different way, the storage section 43 stores the plurality of monitoring region data pieces RD according to the specifications of the lower travelling body 10. The storage section 43 stores a plurality of monitoring region data pieces RD in advance. Then, the operator inputs information of the lower attachment to an input device (not shown). This causes the control section 41 to select the monitoring region data piece RD according to the input information of the lower attachment from among the plurality of monitoring region data pieces RD. As a result, the relationship between the turn angle α and the monitoring region R after the change of the specification of the lower travelling body 10 shown in FIG. 1 is automatically determined (when expressed in a different way, defined or updated).

(Calibration)

It is assumed, for example, that a specification of the lower travelling body 10 is changed at, for example, an operation site of the construction machine 1, and the plurality of monitoring region data pieces RD (see FIG. 2) corresponding to the lower travelling body 10 whose specification has been changed is not stored in the storage section 43 (see FIG. 2). It is assumed, for example, that the plurality of monitoring region data pieces RD corresponding to a structure whose structure data are not present in a manufacturer of the construction machine 1, and the plurality of monitoring region data pieces RD corresponding to a structure having a peculiar specification are not stored in the storage section 43. In such a case, calibration is conducted in the following manner for obtaining the plurality of monitoring region data pieces RD corresponding to the lower travelling body 10 after the change of the specification.

While causing the upper slewing body 20 to make one turn, the control section 41 causes the obstacle detection section 50 to detect the lower travelling body 10. The turn angle α at the start of turning may not necessarily be 0°. This calibration is preferably conducted in a state where no obstacle is present around the construction machine 1, and additionally, it is preferably conducted at a place where the ground is as flat as possible. At this time, the control section 41 generates the plurality of monitoring region data pieces RD (see FIG. 2) according to a position of the lower travelling body 10 detected by the obstacle detection section 50. In more detail, the monitoring region data RD is generated by which the lower travelling body 10 is not included in the monitoring region R at whichever turn angle α. Then, the control section 41 causes the storage section 43 (see FIG. 2) to store the generated monitoring region data RD.

In other words, the control section includes a monitoring region data generating section which generates the monitoring region data by causing the obstacle detection section to detect the lower travelling body while causing the upper slewing body to make one turn, and which causes the storage section to store the generated monitoring region data.

As described in the foregoing, the construction machine 1 includes the lower travelling body 10, the upper slewing body 20, and the control section 41, the turn angle detection section 45, and the obstacle detection section 50 shown in FIG. 2. As shown in FIG. 1, the upper slewing body 20 is turnable with respect to the lower travelling body 10. The control section 41 (see FIG. 2) controls travelling of the lower travelling body 10, and turning of the upper slewing body 20 with respect to the lower travelling body 10. The turn angle detection section 45 (see FIG. 2) detects the turn angle α of the upper slewing body 20 with respect to the lower travelling body 10 and inputs the detection result to the control section 41 (see FIG. 2). The obstacle detection section 50 is attached to the upper slewing body 20 to detect an obstacle and input a detection result to the control section 41 (see FIG. 2).

Then, the construction machine 1 has such a characteristic configuration as follows.

[Configuration 1-1]

The control section 41 (see FIG. 2) determines, as a monitoring region R, a region in which an obstacle is to be monitored and which fails to include the lower travelling body 10. In other words, the control section includes a monitoring region determination section which determines, as a monitoring region, a region in which an obstacle is to be monitored and which fails to include a lower travelling body.

[Configuration 1-2]

The control section 41 shown in FIG. 2 changes the monitoring region R shown in FIG. 5 based on the turn angle α detected by the turn angle detection section 45 such that the lower travelling body 10 is not included in the monitoring region R. In other words, the control section includes the monitoring region changing section which changes a monitoring region based on a turn angle detected by the turn angle detection section such that the lower travelling body is not included in the monitoring region.

[Configuration 1-3]

When the obstacle detection section 50 detects an obstacle in the monitoring region R, the control section 41 (see FIG. 2) limits at least one operation of travelling of the lower travelling body 10 and turning of the upper slewing body 20. In other words, the control section includes the operation limiting section which limits at least one operation of travelling of the lower travelling body and turning of the upper slewing body when the obstacle detection section detects an obstacle in the monitoring region.

Since the construction machine 1 is provided with the above [Configuration 1-1] and [Configuration 1-2], even when the turn angle α shown in FIG. 1 changes, the lower travelling body 10 is not determined as an obstacle in the monitoring region R. As a result, the construction machine 1 enables a problem of erroneously limiting at least one operation of travelling and turning to be suppressed (as to limitation, see [Configuration 1-3]). In other words, it is possible to prevent work by the construction machine 1 from being unnecessarily interrupted during the work. Additionally, the construction machine 1 includes the above [Configuration 1-2]. Accordingly, when the turn angle α changes, the monitoring region R can be narrowed and the monitoring region R can be widened. In a case where the monitoring region R is widened when the turn angle α changes, the construction machine 1 suppresses narrowing of the monitoring region R more than necessary. Accordingly, even when the turn angle α changes, the construction machine 1 suppresses erroneous determination of the lower travelling body 10 as an obstacle, and even when the turn angle α changes, it is possible to detect an obstacle being present in the vicinity of the lower travelling body 10.

Additionally, the construction machine 1 has such a characteristic configuration as follows in addition to the above characteristic configuration.

[Configuration 2]

The construction machine 1 includes the storage section 43 (see FIG. 2). The storage section 43 stores the plurality of monitoring region data pieces RD (see FIG. 2) in advance as data for determining the monitoring region R. The control section 41 shown in FIG. 2 reads the monitoring region data piece RD stored in the storage section 43 based on the turn angle α detected by the turn angle detection section 45 to determine the monitoring region R (see FIG. 1) based on the read monitoring region data piece RD. In other words, the monitoring region determination section provided in the control section reads the monitoring region data piece stored in the storage section based on a turn angle detected by the turn angle detection section to determine a monitoring region based on the read monitoring region data piece.

The construction machine 1 provided with the above [Configuration 2] is capable of suppressing a computation amount of the control section 41 for determining the monitoring region R according to the turn angle α shown in FIG. 1. Specifically, for example, it is not necessary for the control section 41 to determine by computation, while causing the obstacle detection section 50 to constantly detect the lower travelling body 10, the monitoring region R that fails to include the detected lower travelling body 10. Additionally, an amount of data transmitted and received between devices for determining the monitoring region R according to the turn angle α can be suppressed. As a result of suppression of a computation amount and a data amount, control response by the control section 41 (see FIG. 2) can be improved. For example, in a case where an obstacle suddenly intrudes into the monitoring region R, operation of the construction machine 1 can be quickly limited (when expressed in a different way, time-lag at the time of limiting operation of the construction machine 1 can be suppressed).

Additionally, the construction machine 1 has such a characteristic configuration as follows in addition to the above characteristic configurations.

[Configuration 3]

The storage section 43 (sec FIG. 2) stores the plurality of monitoring region data pieces RD (see FIG. 2) in advance with respect to each of presence/absence and a kind of a structure (lower attachment) attachable to the lower main body 11 of the lower travelling body 10 shown in FIG. 5. In other words, the storage section 43 stores, as the plurality of monitoring region data pieces RD, data in a case where no structure is attached to the lower main body 11, and data according to a kind of a structure attached to the lower main body 11. When expressed in a different way, the storage section 43 stores the plurality of monitoring region data pieces RD according to the specifications of the lower travelling body 10.

The construction machine 1 provided with the above [Configuration 3] obtains such effect as described above (i.e. the effect of suppressing a computation amount of the control section 41 for determining the monitoring region R according to the turn angle α shown in FIG. 1) even when the lower attachment is attached to the lower main body 11 or when a kind of the lower attachment is changed. As a result, the construction machine 1 is allowed to easily cope with a change of the specifications of the lower travelling body 10.

Additionally, the construction machine 1 has such a characteristic configuration as follows in addition to the above characteristic configurations.

[Configuration 4]

The control section 41 (see FIG. 2) generates the plurality of monitoring region data pieces RD shown in FIG. 2 by causing the obstacle detection section 50 to detect the lower travelling body 10 while causing the upper slewing body 20 shown in FIG. 1 to make one turn, and causes the storage section 43 to store the generated monitoring region data pieces RD. In other words, the control section 41 includes the monitoring region data generating section which generates the plurality of monitoring region data pieces RD by causing the obstacle detection section 50 (the left side sensor 51, the right side sensor 52, and the rear side sensor 53) to detect the lower travelling body 10 while causing the upper slewing body 20 to make one turn, and causes the storage section 43 to store the generated monitoring region data pieces RD.

Even when the data related to the lower travelling body 10 (see FIG. 1) not stored in advance in the storage section 43 are used, the construction machine 1 provided with the above [Configuration 4] is allowed to easily store the plurality of monitoring region data pieces RD, resulting in obtaining such effect as described above (i.e. the effect of suppressing a computation amount of the control section 41 for determining the monitoring region R according to the turn angle α shown in FIG. 1). As a result, the construction machine 1 is allowed to cope with change of a specification of the lower travelling body 10 as circumstances demand (when expressed in a different way, the construction machine 1 is allowed to have high robustness against the change of the specification of the lower travelling body 10).

Additionally, the construction machine 1 has such a characteristic configuration as follows in addition to the above characteristic configurations.

[Configuration 5]

The control section 41 changes the monitoring region R by changing the angle of view β of the obstacle detection section 50 shown in FIG. 5. In other words, the monitoring region changing section provided in the control section changes a monitoring region by changing an angle of view of the obstacle detection section.

The construction machine 1 is provided with the above [Configuration 5]. Accordingly, the construction machine 1 is allowed to suppress a computation amount and a data amount for changing the monitoring region R as compared with a case, for example, where without changing the angle of view β, the monitoring region R is changed by execution, by the control section 41 (see FIG. 2), of computation for excluding a part where the lower travelling body 10 is present from the detection-allowed region D.

Second Embodiment

With respect to a construction machine 201 of a second embodiment, differences from the above embodiment will be described with reference to FIGS. 10 to 14. Of the construction machine 201 of the second embodiment, common parts to those of the first embodiment are given the same reference codes as those of the first embodiment to omit description thereof (omission of description of common parts is also the case with description of a third embodiment). While in the first embodiment, the monitoring region R is changed by changing the angle of view β of the obstacle detection section 50 shown in FIG. 5, in the present embodiment, with the angle of view β of the obstacle detection section 50 shown in FIG. 11 fixed, the monitoring region R is changed by changing an excluded region E.

Figure 10:
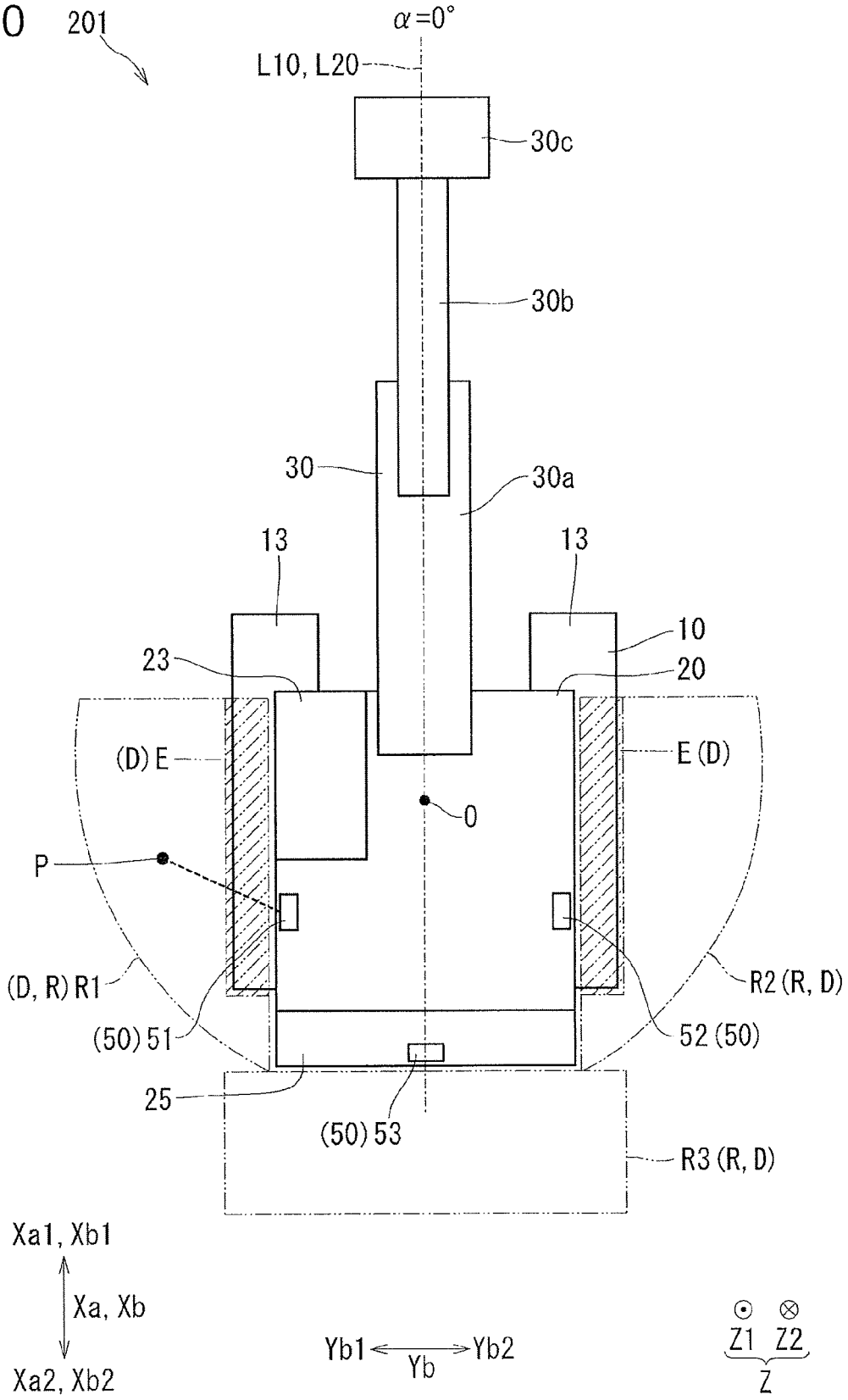
FIG. 10 is a view of a second embodiment, which view corresponds to FIG. 4.
Figure 11:
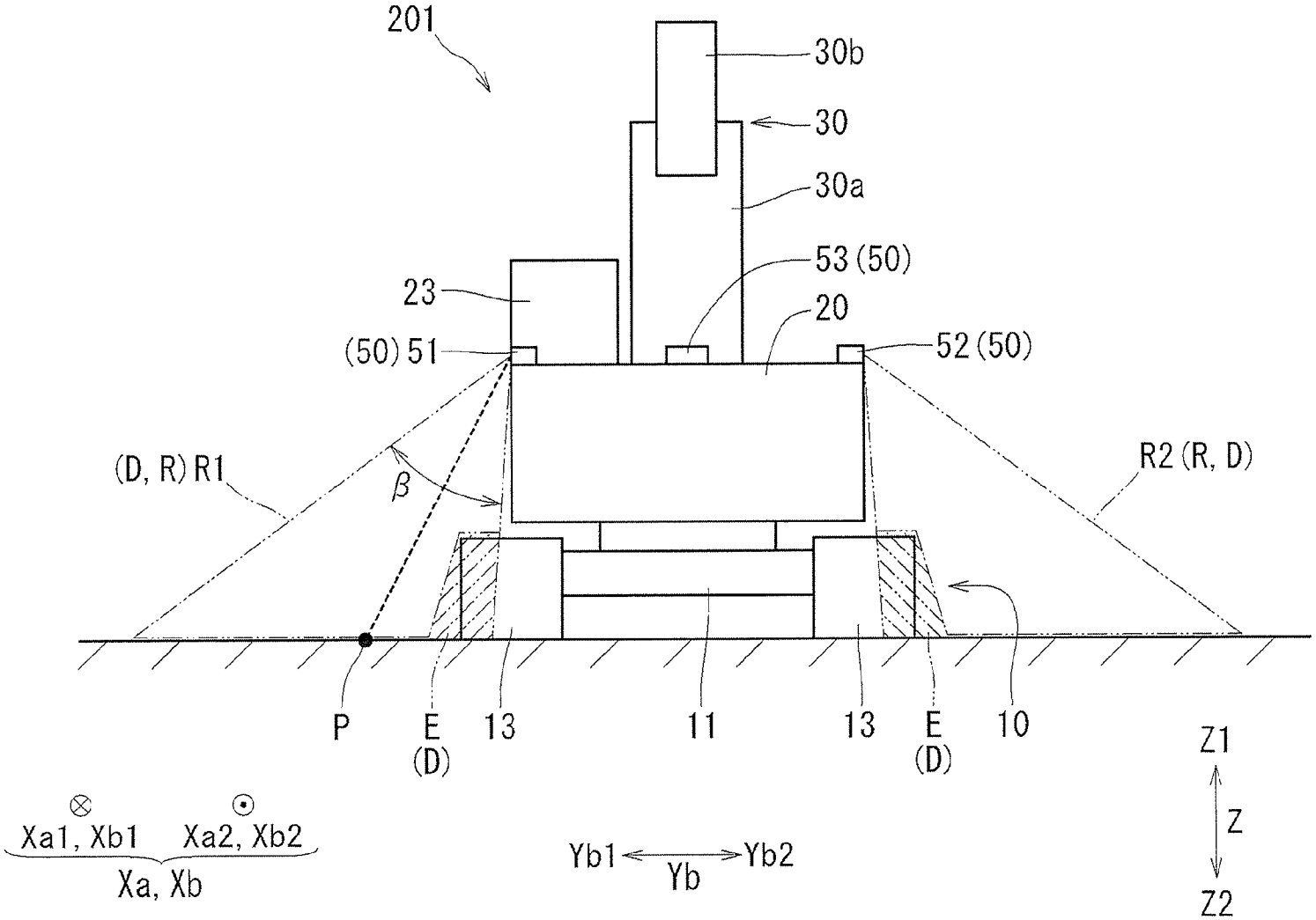
FIG. 11 is a view of the second embodiment, which view corresponds to FIG. 5.

The control section 41 (see FIG. 2) determines, as the monitoring region R, a region obtained by excluding the excluded region E (when expressed in a different way, subtracting) from the detection-allowed region D of the obstacle detection section 50 shown in FIG. 10. Of the detection-allowed region D, a region where the lower travelling body 10 is present is the excluded region E. Additionally, as shown in FIG. 11, in the detection-allowed region D, a part to which light radiated by the obstacle detection section 50 fails to reach due to blocking by the lower travelling body 10 is the excluded region E. In FIGS. 10 to 13, the excluded region B is hatched with chain double-dashed lines. For example, the control section 41 (see FIG. 2) excludes the excluded region E from the detection-allowed region D shown in FIG. 10 by image processing. For example, the control section 41 changes the monitoring region R by changing the excluded region E based on the turn angle α. For example, the storage section 43 stores the excluded region E for each turn angle α in advance. The data related to excluded region E stored in the storage section 43 are included in the plurality of monitoring region data pieces RD (i.e. data related to the monitoring region R). With the monitoring region R determined in advance which is obtained by excluding the excluded region E from the detection-allowed region D, the plurality of monitoring region data pieces RD related to the determined monitoring region R may be stored in the storage section 43 in advance (the same manner as in the first embodiment).

Figure 12:
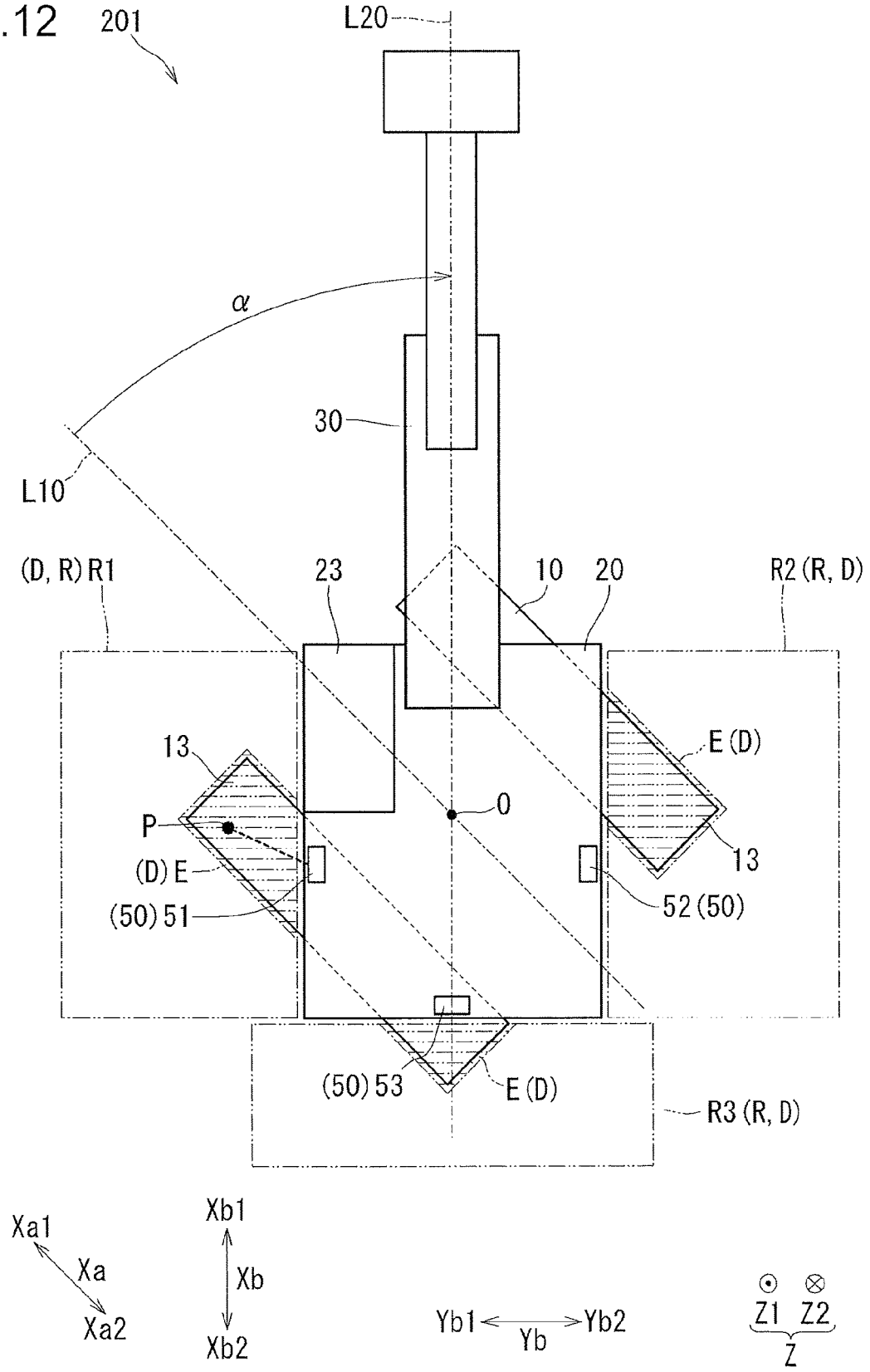
FIG. 12 is a view of the second embodiment, which view corresponds to FIG. 6.
Figure 13:
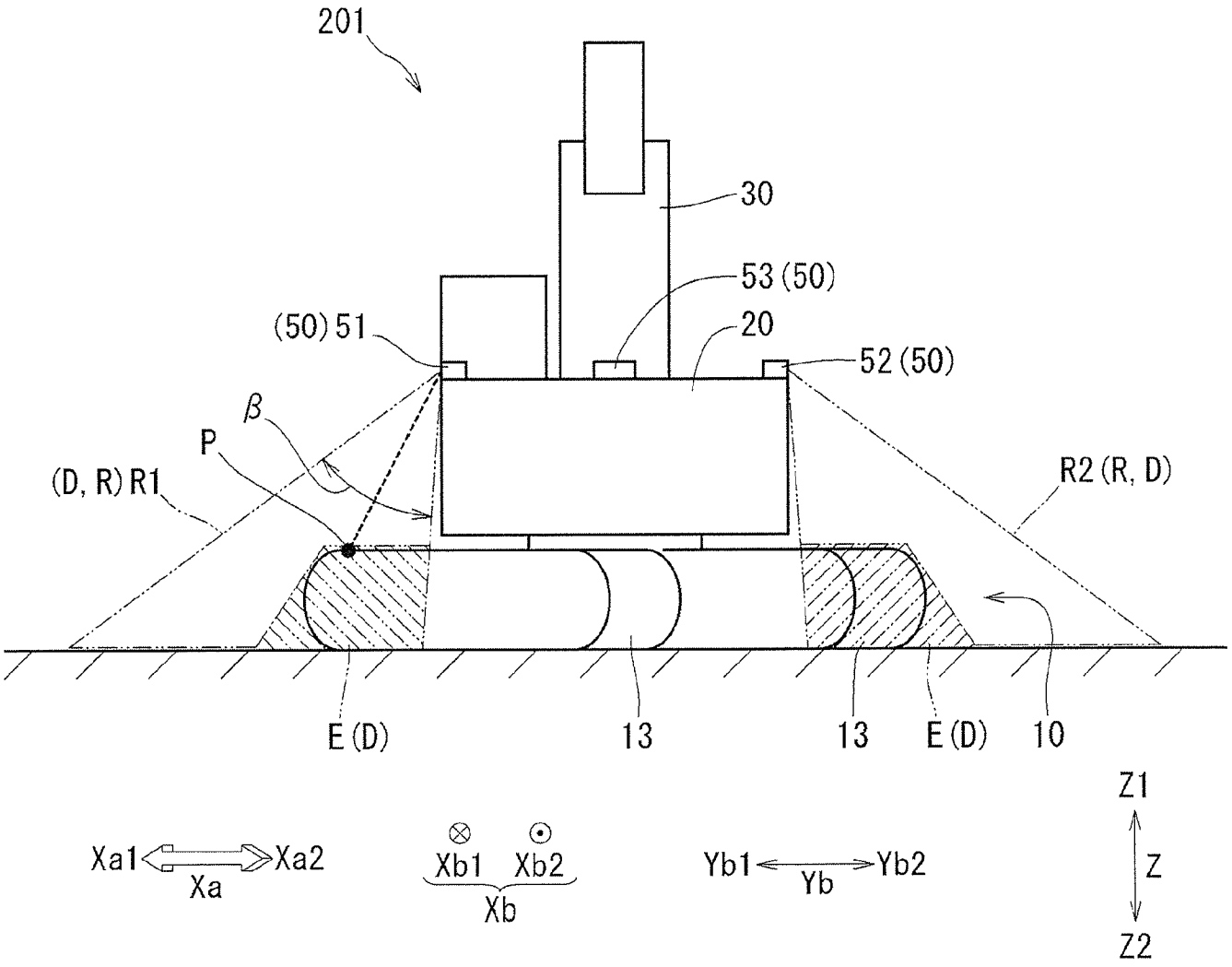
FIG. 13 is a view of the second embodiment, which view corresponds to FIG. 7.
Figure 14:
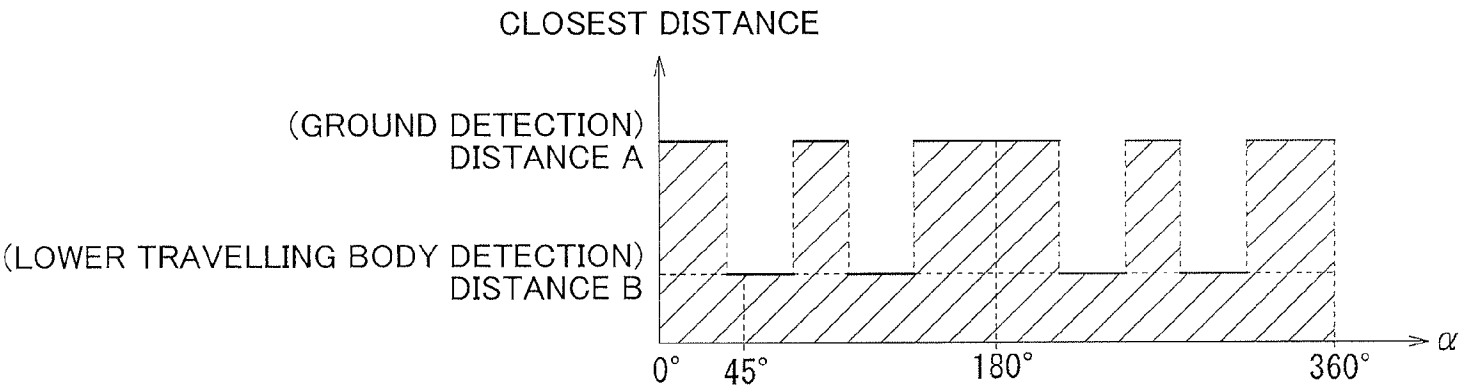
FIG. 14 is a graph related to a ranging point P shown in FIG. 10.

A graph related to a ranging point P in the monitoring region R shown in FIGS. 10 to 13 is shown in FIG. 14. This graph illustrates that the ranging point P has no obstacle. In this graph, the ordinate represents a distance (the closest distance) from the obstacle detection section 50 shown in FIG. 10 (in the example shown in FIG. 10, the left side sensor 51) to an object closest to the obstacle detection section 50. The abscissa of the graph shown in FIG. 14 represents the turn angle α (see FIG. 12). As shown in FIGS. 10 and 11, when the obstacle detection section 50 detects the ground at the ranging point P, the closest distance is a distance A (a ground detection distance, see FIG. 14) from the obstacle detection section 50 to the ground. As shown in FIGS. 12 and 13, when the obstacle detection section 50 detects the lower travelling body 10 at the ranging point P, the closest distance is a distance B (a lower travelling body detection distance, see FIG. 14) from the obstacle detection section 50 to the lower travelling body 10. As can be found in the graph shown in FIG. 14, when the turn angle α changes, the closest distance changes from the distance A to the distance B, or the closest distance changes from the distance B to the distance A. In the graph, a hatched part corresponds to the closest distance included in the monitoring region R (see FIG. 10), and a part not hatched corresponds to the closest distance not included in the monitoring region R.

When an obstacle is present (when expressed in a different way, the obstacle has intruded) in the ranging point P (see FIG. 10), the closest distance is reduced (when expressed in a different way, becomes short) as compared with a case where no obstacle is present in the ranging point P. Specifically, for example, with the turn angle α being 0°, the closest distance when no obstacle is present at the ranging point P (see FIG. 11) is the distance A, and the closest distance when an obstacle is present at the ranging point P becomes shorter than the distance A. For example, with the turn angle α being 45°, the closest distance when no obstacle is present at the ranging point P (see FIG. 13) is the distance B, and the closest distance when an obstacle is present at the ranging point P becomes shorter than the distance B. The graph is a schematic diagram in which, for example, irregularities of the lower travelling body 10 are ignored.

The construction machine 201 of the present embodiment shown in FIG. 10 has such a characteristic configuration as follows.

[Configuration 6]

The angle of view β (see FIG. 11) of the obstacle detection section 50 is fixed. The control section 41 determines, as the monitoring region R, a region obtained by excluding the excluded region E where the lower travelling body 10 is present from the detection-allowed region D from which the obstacle detection section 50 is allowed to detect an object. In other words, the monitoring region determination section determines, as a monitoring region, a region obtained by excluding an excluded region where the lower travelling body is present from a detection-allowed region from which the obstacle detection section is allowed to detect an obstacle. The control section 41 shown in FIG. 2 changes the monitoring region R by changing the excluded region E shown in FIG. 12 based on the turn angle α detected by the turn angle detection section 45. In other words, the monitoring region changing section provided in the control section changes a monitoring region by changing an excluded region based on a turn angle detected by the turn angle detection section.

The construction machine 201 provided with the above [Configuration 6] is allowed to widen the monitoring region R in the vicinity of the lower travelling body 10 more easily as compared with a case where the monitoring region R is changed only by changing the angle of view β (see FIG. 11). Accordingly, the construction machine 201 is allowed to detect an obstacle in the vicinity of the lower travelling body 10 more easily as compared with a case where the monitoring region R is changed only by changing the angle of view β, that is, as compared with the construction machine 1.

Third Embodiment

Figure 15:
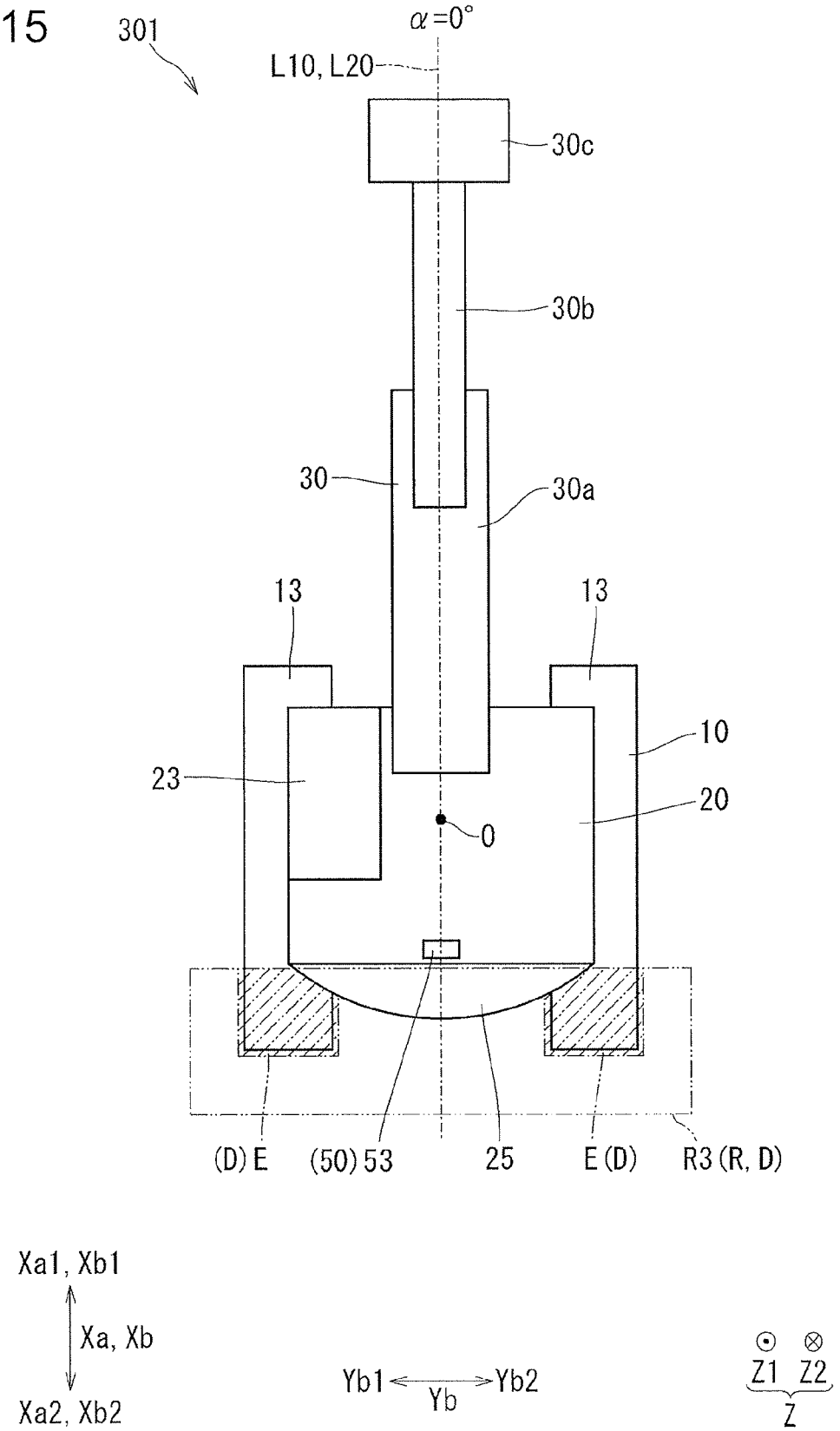
FIG. 15 is a view of a third embodiment, which view corresponds to FIG. 4.

With respect to a construction machine 301 of a third embodiment, differences from the first embodiment will be described with reference to FIG. 15. In the construction machine 1 (i.e. a conventional machine) of the first embodiment shown in FIG. 1, when the upper slewing body 20 turns, when seen from the up-down direction Z, the end portion on the upper slewing body rear side Xb2 of the upper slewing body 20 protrudes from either the right or left crawler 13. On the other hand, in the construction machine 301 (i.e. a rear small slewing machine) of the present embodiment shown in FIG. 15, when the upper slewing body 20 turns, when seen from the up-down direction Z, the end portion on the upper slewing body rear side Xb2 of the upper slewing body 20 does not protrude (or hardly protrude) from either the right or left crawler 13. Therefore, provision of the left side sensor 51 and the right side sensor 52 shown in FIG. 1 may not necessarily be required. In the construction machine 301 shown in FIG. 15, the left side sensor 51 and the right side sensor 52 may be provided for, for example, detecting an obstacle on the lower travelling body 10.

(Modification)

Arrangement and shapes of the respective components of the above embodiments may be changed. Connection and the like of each component shown in the block diagram of FIG. 2 may be changed. An order and the like of each step (processing) of the flow chart shown in FIG. 3 may be changed.

The components of the embodiments different from each other may be combined. For example, the monitoring region R may be changed by changing, when the turn angle α is changed, the excluded region E as in the second embodiment, as well as changing the angle of view β of the obstacle detection section 50 as in the first embodiment.

A part of the components of the above embodiments and the modification may not necessarily be provided, and the number of components may be changed. The obstacle detection section 50 may not necessarily detect an obstacle on the right and left crawlers 13. "The main body portion" of the lower travelling body 10 may include not only the lower main body 11 but also a crawler frame supporting the right and left crawlers 13. To the crawler frame, a structure may be attached.

Figure 8:
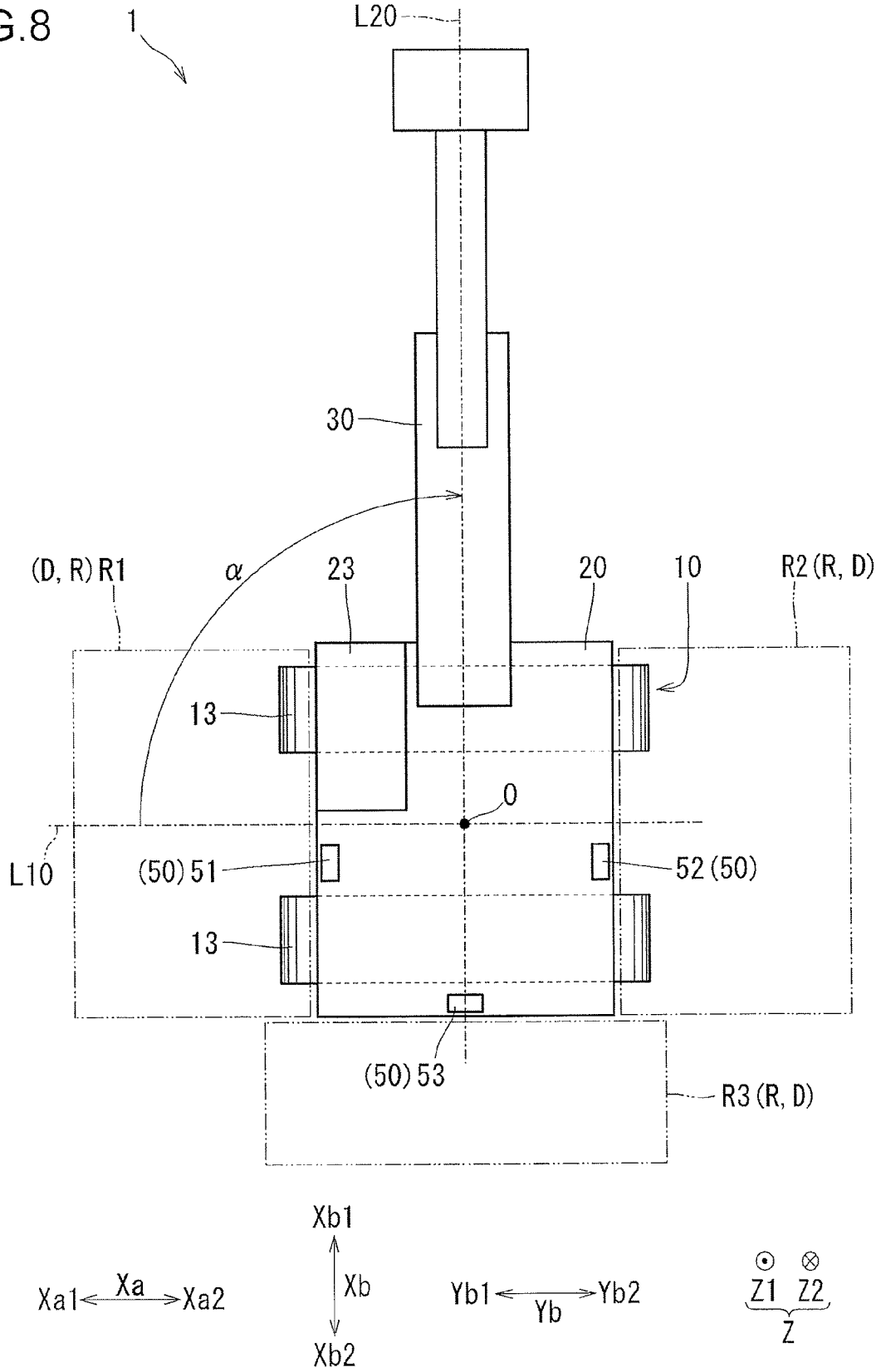
FIG. 8 is a view corresponding to FIG. 1, in which view the turn angle α shown in FIG. 1 is 90°.

In the example shown in FIG. 8, when the upper slewing body front-rear direction Xb and the lower travelling body front-rear direction Xa are orthogonal to each other (referred to as "case C5"), the rear side monitoring region R3 is set. However, in the above "case C5", when a shape of the end portion on the upper slewing body rear side Xb2 of the upper slewing body 20 when seen from the up-down direction Z is an arc-shape (or an approximate arc-shape) with the center of turn O as a center (or an approximate center), the rear side monitoring region R3 may not necessarily be set. In this case, even when an obstacle is present in a region corresponding to the rear side monitoring region R3, the upper slewing body rear side Xb2 part of the upper slewing body 20 does not contact an obstacle.

In the above embodiment, the control section 41 determines the monitoring region R shown in FIG. 10 based on the monitoring region data RD (sec FIG. 2) according to the turn angle α. On the other hand, the control section 41 may cause the obstacle detection section 50 to constantly detect the lower travelling body 10 and determine, by computation, the monitoring region R that fails to include the detected lower travelling body 10.

This application is based on Japanese Patent application No. 2017-055823 filed in Japan Patent Office on Mar. 22, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a lower travelling body;

an upper slewing body turnable with respect to the lower travelling body;

a controller to control travelling of the lower travelling body, and turning of the upper slewing body with respect to the lower travelling body;

a turn angle detection sensor to detect a turn angle of the upper slewing body with respect to the lower travelling body to input a detected turn angle to the control section; and an obstacle detection sensor attached to the upper slewing body to detect an obstacle and input a detection result to the controller, wherein the controller determines a monitoring region in which an obstacle is to be monitored, the monitoring region not including the lower travelling body, the controller changes the monitoring region so as not to include the lower travelling body in the monitoring region, based on the turn angle detected by the turn angle detection sensor, the controller limits operation of at least one of travelling of the lower travelling body and turning of the upper slewing body when the obstacle detection sensor detects an obstacle being present in the monitoring region, and based upon a change in the turn angle detected by the turn angle detection sensor, the controller changes the monitoring region to exclude portions of the lower travelling body that are observed by the obstacle detection sensor.

2. The construction machine according to claim 1, further comprising a memory which stores, in advance, a plurality of monitoring region data pieces according to respective turn angles of the upper slewing body with respect to the lower travelling body to determine the monitoring region, wherein the controller selects a monitoring region data piece corresponding to the turn angle detected by the turn angle detection sensor from the plurality of monitoring region data pieces stored in the memory to determine the monitoring region.

3. The construction machine according to claim 2, wherein the memory stores in advance the plurality of monitoring region data pieces according to a specification of the lower travelling body.

4. The construction machine according to claim 2, wherein the controller generates the plurality of monitoring region data pieces by causing the obstacle detection sensor to detect the lower travelling body while causing the upper slewing body to make one turn, and causes the memory to store the plurality of monitoring region data pieces generated by the controller.

5. The construction machine according to claim 1, wherein the obstacle detection sensor is capable of obtaining an image, and the controller changes an angle of view to thereby changing the monitoring region, the angle of view indicating a range of the image obtained by the obstacle detection sensor.

6. The construction machine according to claim 1, wherein the obstacle detection sensor is capable of obtaining an image;

an angle of view is fixed, the angle of view indicating a range of the image obtained by the obstacle detection sensor;

the controller determines, as the monitoring region, a region obtained by excluding an excluded region where the lower travelling body is present from a detection-allowed region in which the obstacle detection sensor is able to detect an object; and the controller changes the monitoring region by changing the excluded region based on the turn angle detected by the turn angle detection sensor.

* * * * *